US006032334A

United States Patent [19]

Iima et al.

[11] Patent Number: 6,032,334

[45] Date of Patent: Mar. 7, 2000

[54] HANDLE APPARATUS

[75] Inventors: Shin Iima; Ryuzoh Maruyama, both of Tokyo, Japan

[73] Assignees: Sony Corporation; Asahi Corporation, both of Tokyo, Japan

[21] Appl. No.: 09/088,883

[22] Filed: Jun. 2, 1998

[30] Foreign Application Priority Data

Jun. 3, 1997 [JP] Japan ..... 9-145136

[51] Int. Cl.[7] ..... A47B 95/02

[52] U.S. Cl. ..... 16/405; 16/444

[58] Field of Search ..... 16/125, 126, 115; 190/115, 39

[56] References Cited

U.S. PATENT DOCUMENTS 3,113,651 12/1963 Szabo et al. ..... 16/125
3,340,970 9/1967 Szabo ..... 16/125
3,340,971 9/1967 Szabo ..... 16/125
3,353,205 11/1967 Sheiman ..... 16/125
3,795,941 3/1974 Szabo et al. ..... 16/125
4,066,155 1/1978 Buchek ..... 190/115

*Primary Examiner*—Chuck Y. Mah
*Attorney, Agent, or Firm*—Jay H. Maioli

[57] ABSTRACT

A handle apparatus includes a spring member formed of a wire rod is bent in an approximately U-shape. Both tip end portions of the spring member formed in the approximately U-shape are bent approximately at a right angle and are shaft portions for rotating the approximately U-shaped portions. Both the shaft portions are set such that the axial lines of the shaft portions are not in conformity with each other. Both the shaft portions are made to be members for generating a biasing force in accordance with rotating positions. The spring member 3 is used as a member for generating the biasing force for performing a pop-up operation. A base member 4 and a handle grip member 2 are connected to each other through a pair of spring members 3. The handle grip member is held on a side of the base member against the biasing of the spring members by a lock mechanism 50 arranged on the base member side. The handle grip member 2 is popped up by the biasing force of the spring members 3 by releasing a lock of the locking mechanism.

5 Claims, 11 Drawing Sheets

W1 > W2

HANDLE APPARATUS

BACKGROUND OF THE INVENTION

The present invention relates to a handle apparatus suitable for various kinds of portable electronic apparatuses and a spring member utilized in this handle apparatus.

In an apparatus of portable size and weight fixedly used normally in a certain place such as a projector device, a compact television receiver, a portable computer, a printer, an OHP, etc., a handle apparatus is formed and used as a grip in carrying the apparatus of portable size and weight.

There is a known a handle apparatus normally housed in a storing position within the portable apparatus and a handle grip portion of the handle apparatus is pulled out, rotated or raised only when the portable apparatus is carried.

For example, a handle apparatus shown in FIGS. 1A and 1B is normally stored to the upper face of a portable apparatus in a state in which a handle grip HG is transversally brought down. In this handle apparatus, the handle grip HG is rotated at a using time.

However, in such a handle apparatus, an area of the handle grip transversally brought down at a storing time is large, and an operating range of the handle grip for rotation is wide. Accordingly, a design and an external appearance of the handle apparatus are greatly restricted by the handle grip, etc.

Another handle apparatus as shown in FIGS. 2A and 2B is also considered. In this handle apparatus, for example, a lock is released by further pushing a handle grip HG1 stored to the upper face of a portable apparatus so that a handle grip portion is popped up. In this case, an area required for the handle apparatus is reduced on the upper face of the portable apparatus in plan view so that the handle apparatus is suitable for an external appearance design of the portable apparatus. However, a complicated biasing mechanism using a spring, etc. as the handle apparatus is required for such a pop-up mechanism. Accordingly, the handle apparatus itself is complicated and large-sized and cost of the handle apparatus is increased.

SUMMARY OF THE INVENTION

An object of the present invention is to realize a handle apparatus of a pop-up type having a very simple structure.

Therefore, a member for generating a biasing force for performing a pop-up operation is formed in a state in which a wire rod is bent in an approximately U-shape. Both tip end portions of this member formed in the approximately U-shape are bent approximately at right angles as shaft portions for rotating the approximately U-shaped portion. Both the shaft portions form spring members set such that the axial lines of these spring members are not in conformity with each other.

A handle apparatus is formed of a base member (or a handle mounting portion integral with or separate from a cabinet of an apparatus, etc.), a handle grip member, a pair of spring members for connecting the base member and the handle member to each other, and a lock mechanism arranged on a side of the base member and holding the handle grip member on the base member side.

The spring members are constructed as above. Two pairs of shaft holes are formed in the base member in accordance with the respective shaft portions of the spring members such that no axial lines of these shaft holes are in conformity with each other. The respective spring members are rotatably supported by these shaft holes. Thus, biasing force for biasing the handle grip member connected to the approximately U-shaped portion of each of the spring members in a direction for releasing the handle grip member from the base member is generated in each of the spring members.

The handle grip member is raised by the biasing force of each of the spring members to a position separated from the base member in a state in which the holding of the handle grip member using the lock mechanism is released.

Namely, in the present invention, the biasing force is generated in accordance with a rotating position such that the respective tip ends of the wire rod formed in the U-shape are set to shaft portions and both the shaft portions thereof are set to rotating shafts on axial lines different from each other. Thus, since the biasing force is generated in accordance with rotating positions, the pop-up operation can be performed by a very simple structure.

DETAILED DESCRIPTION OF THE PREFERRED EMBODIMENTS

An embodiment of a spring member, a handle apparatus and a portable apparatus according to the present invention will be described with reference to FIGS. 3 to 13.

FIG. 3 is a perspective view showing a portable type projector 90 as an example of a portable apparatus.

A handle apparatus 1 serves as a grip in carrying the projector 90 and is attached onto an upper face of the projector 90.

Figure 1A:
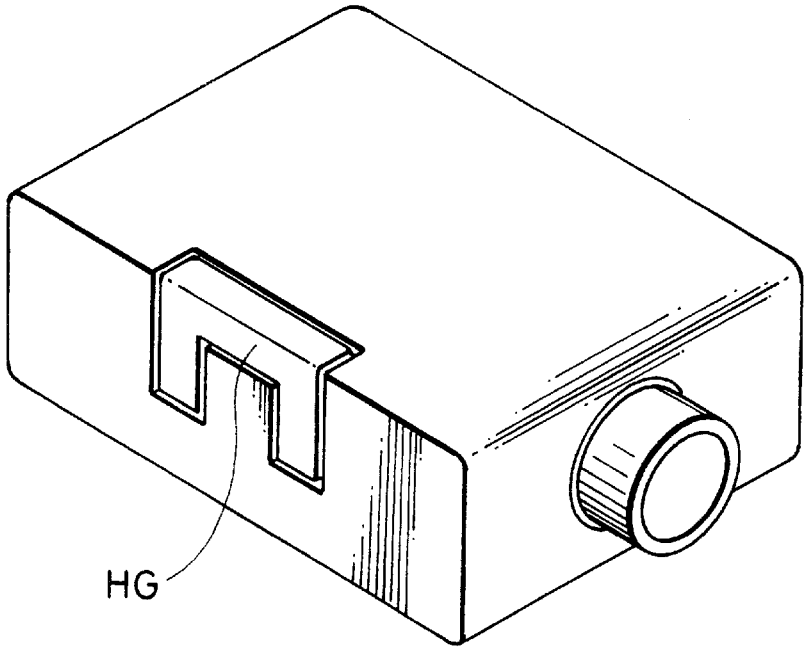
FIG. 1A (PRIOR ART)
FIGS. 1A and 1B are diagrams showing a rotary-type handle.
Figure 1B:
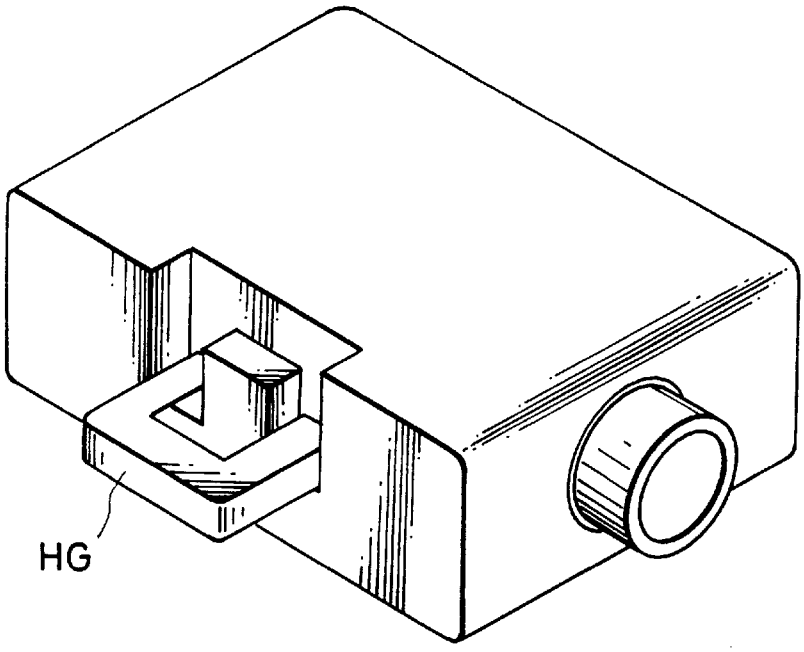
FIG. 1B (PRIOR ART)
Figure 2A:
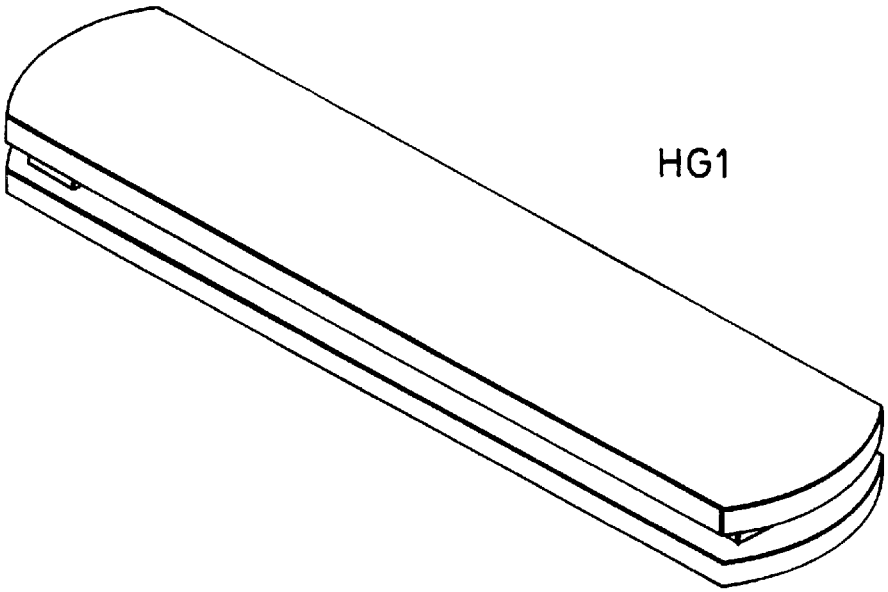
FIG. 2A (PRIOR ART)
FIGS. 2A and 2B are diagrams showing a pop-up type handle.
Figure 2B:
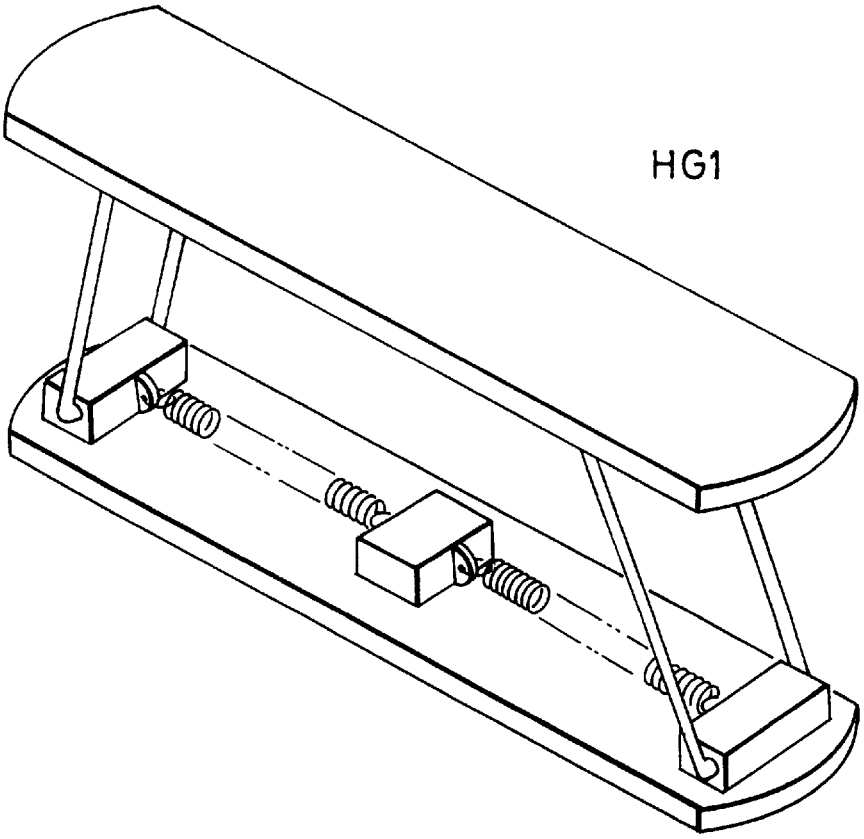
FIG. 2B (PRIOR ART)
Figure 3A:
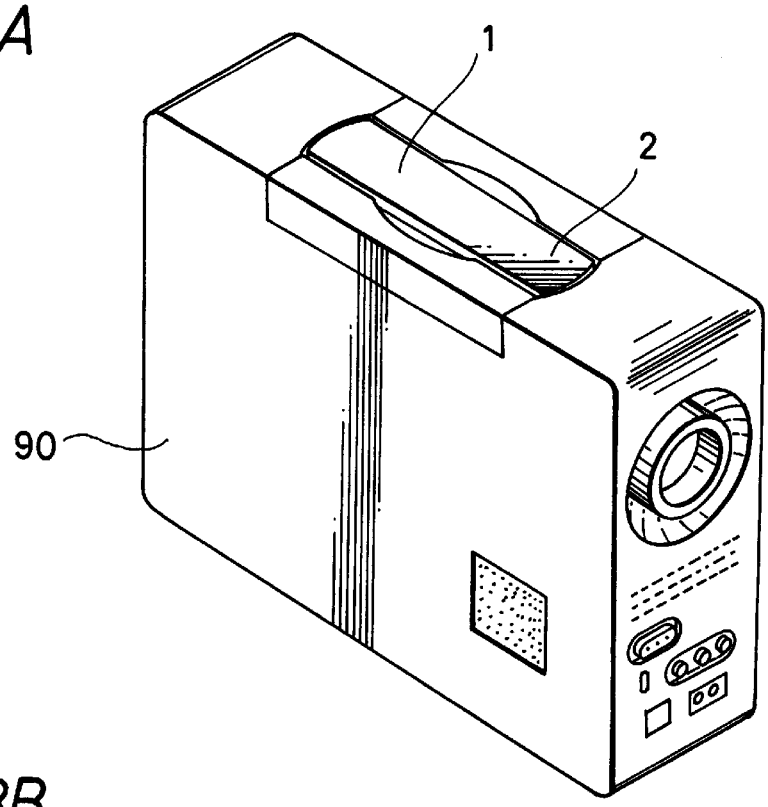
FIGS. 3A and 3B are perspective views showing a projector as an embodiment of a portable apparatus according to the present invention.

As shown in FIG. 3A, this handle apparatus 1 is normally housed in the upper face of the projector 90. In the handle apparatus 1, a handle grip 2 is used as a grip for carrying the projector 90. In a housed state of the handle grip 2, an upper face of the handle grip 2 is set to be approximately in conformity with the upper face of a box body of the projector 90 in height.

Figure 3B:
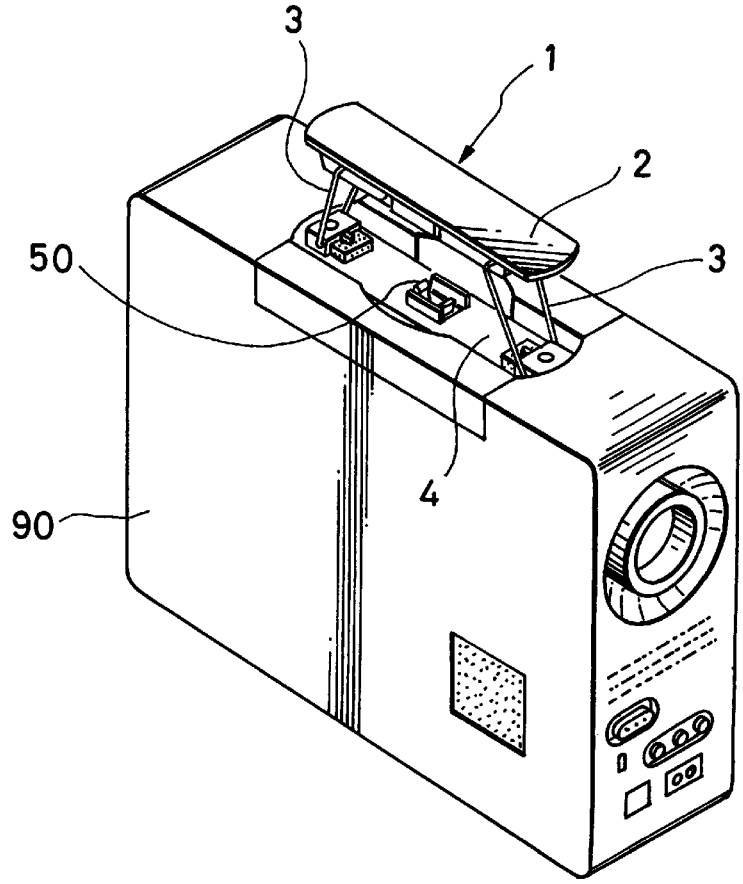

The lock of an internal lock mechanism 50 is released by pushing the upper face of the handle grip 2 from the housed state of FIG. 3A. As shown in FIG. 3B, the handle grip 2 is then popped up from a base 4 by the biasing force of each of links 3, 3 of a spring member described later.

In this state, a user uses the handle grip 2 as a grip and can carry the projector 90.

The base 4 is a base member constituting the handle apparatus 1. The base 4 may be formed as one portion of a box body cabinet of the projector 90. The base 4 may be also fixedly mounted to the cabinet a part separate from the cabinet.

Figure 4:
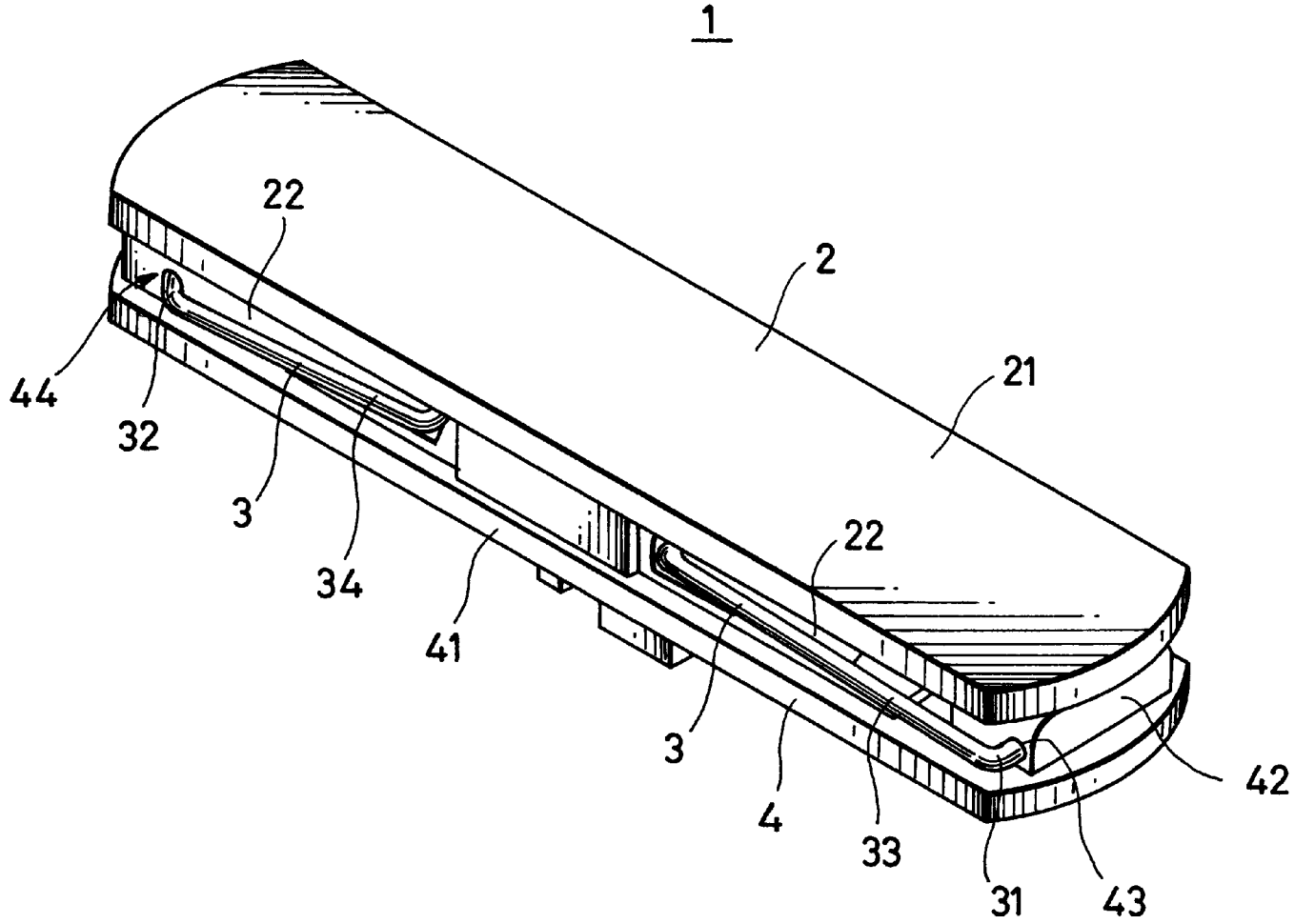
FIG. 4 is a perspective view showing a handle apparatus of an embodiment according to the present invention in a housed state.
Figure 5:
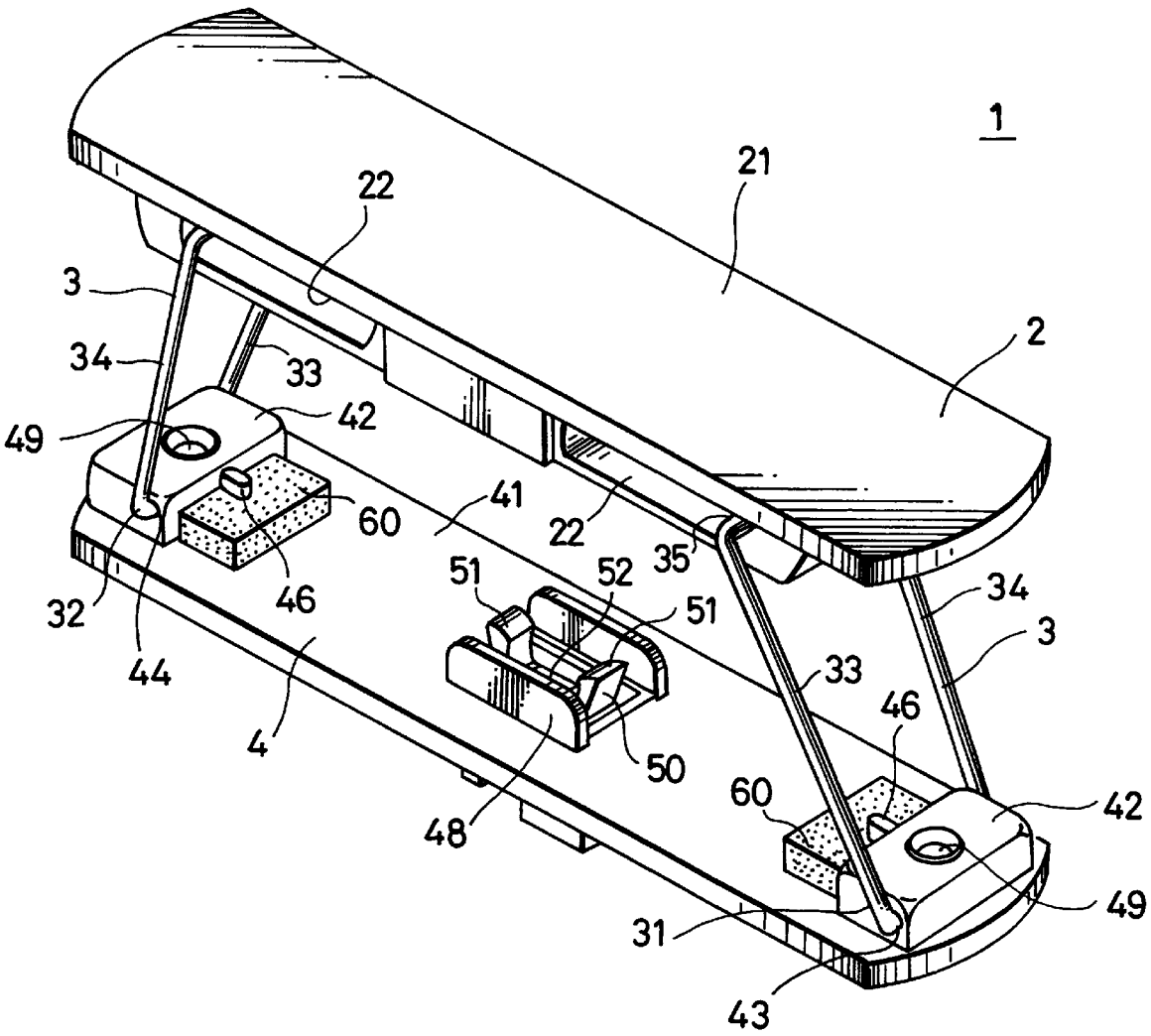
FIG. 5 is a perspective view showing the handle apparatus of the embodiment according to the present invention in a released state.

FIGS. 4 and 5 are perspective views showing the construction of the handle apparatus 1. This handle apparatus 1 is attached to an apparatus such as the projector 90, etc. as shown in FIGS. 3A and 3B. In this example, the base 4 constituting the handle apparatus 1 is formed as a part separate from the box body cabinet of this apparatus and is fixedly mounted to this apparatus.

FIG. 4 is a perspective view of the handle apparatus 1 when the handle apparatus 1 is in a housed state as shown in FIG. 3A, while FIG. 5 is a perspective view of the handle apparatus 1 in a state in which the handle apparatus 1 is popped up as shown in FIG. 3B.

This handle apparatus 1 is basically constructed of the handle grip 2, the link 3 and the base 4. Further, the lock mechanism 50 for holding the handle grip 2 in the housed state is provided in the base 4.

Each of the handle grip 2, the link 3 and the base 4 constituting the handle apparatus 1 will be first explained.

FIGS. 8A to 8D are respectively a plan view, a side view, a front view and a perspective view showing a shape of the link 3 functioning as a spring member and connecting the handle grip 2 and the base 4.

Figure 8A:
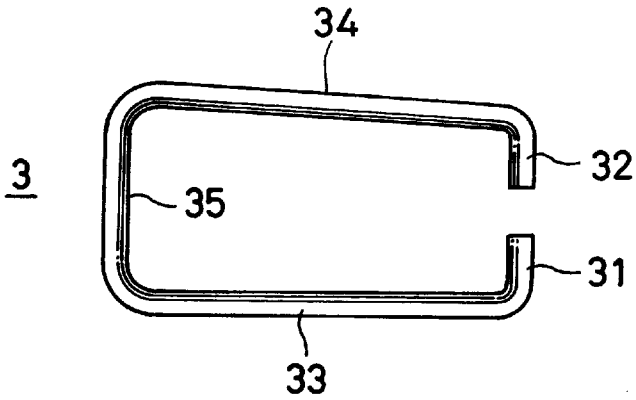
FIGS. 8A to 8D are respectively a plan view, a side view, a front view and a perspective view of a link of the handle apparatus which is an embodiment of a spring member according to the present invention.

As can be seen from FIG. 8A, the link 3 is formed by bending a metallic wire rod in an approximately U-shape. Namely, its arm portions 33, 34 are continuously connected to each other by a connecting portion 35 so that the link 3 is formed in the approximately U-shape.

Respective tip end portions of the arm portions 33, 34 are respectively bent approximately 90° toward the other arm sides and are made as shaft portions 31, 32.

Figure 8B:
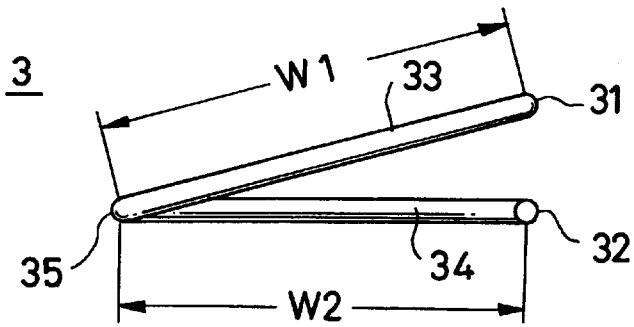
Figure 8C:
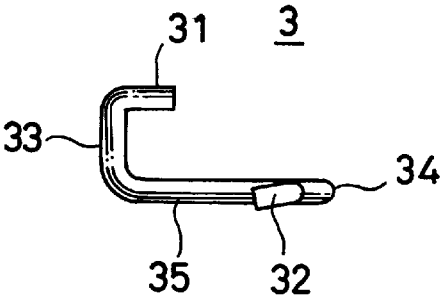
Figure 8D:
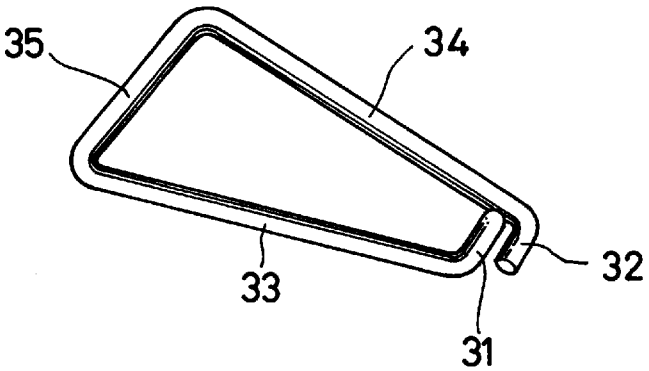

Further, as can be seen from FIGS. 8B to 8D, the arms 33, 34 are not arranged in parallel with each other so that the shaft portions 31, 32 at the respective tip ends of the arms 33, 34 are not opposed to each other and hence the axial lines of these shaft portions 31, 32 are different from each other.

A length W1 of the arm portion 33 is set to be longer by a predetermined length than a length W2 of the arm portion 34.

Figure 9A:
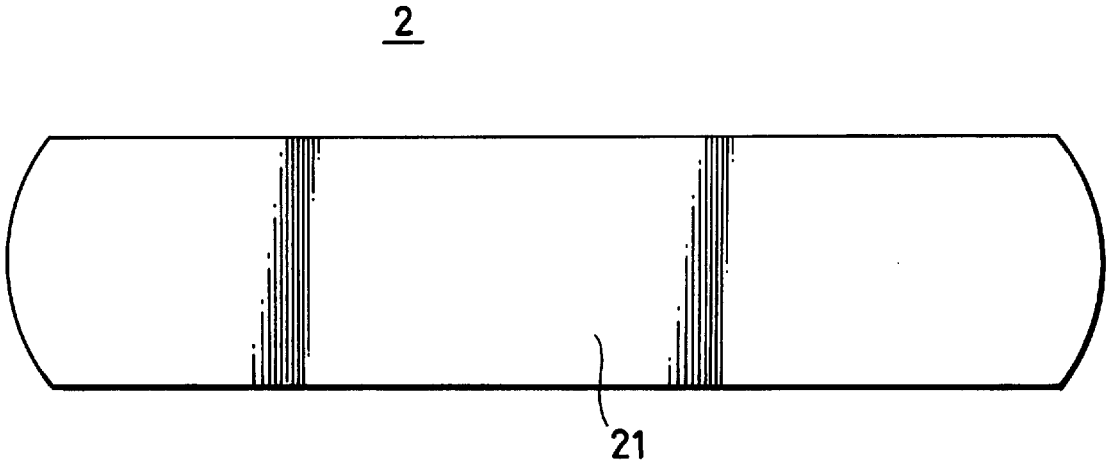
FIGS. 9A to 9C are respectively a plan view, a side view and a bottom view of a handle grip of the handle apparatus in the embodiment.
Figure 9B:
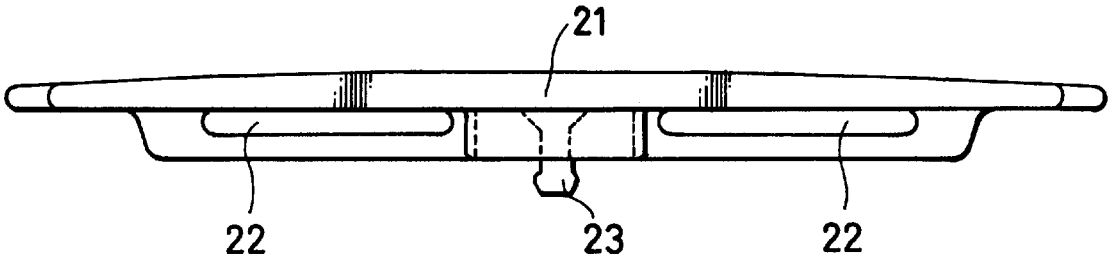
Figure 9C:
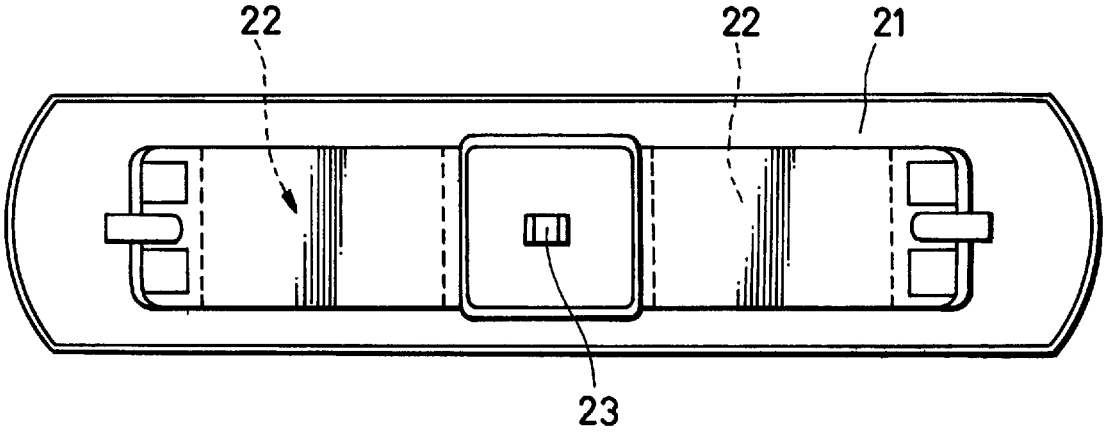

FIGS. 9A to 9C are respectively a plan view, a side view and a bottom view of the handle grip 2.

As can be seen from FIGS. 9B and 9C, two link holes 22, 22 are formed on the lower side of a body portion 21 of the handle grip 2. Each link hole 22 is set to an elongated hole into which the connecting portion 35 of the link 3 can be inserted. The connecting portion 35 of the link 3 can be moved within this link hole 22 in left-hand and right-hand directions in FIG. 9B.

A lock pin 23 to be engaged with the lock mechanism (push latch) 50 is projected at a center of the handle grip 2 on its lower face side.

Figure 10A:
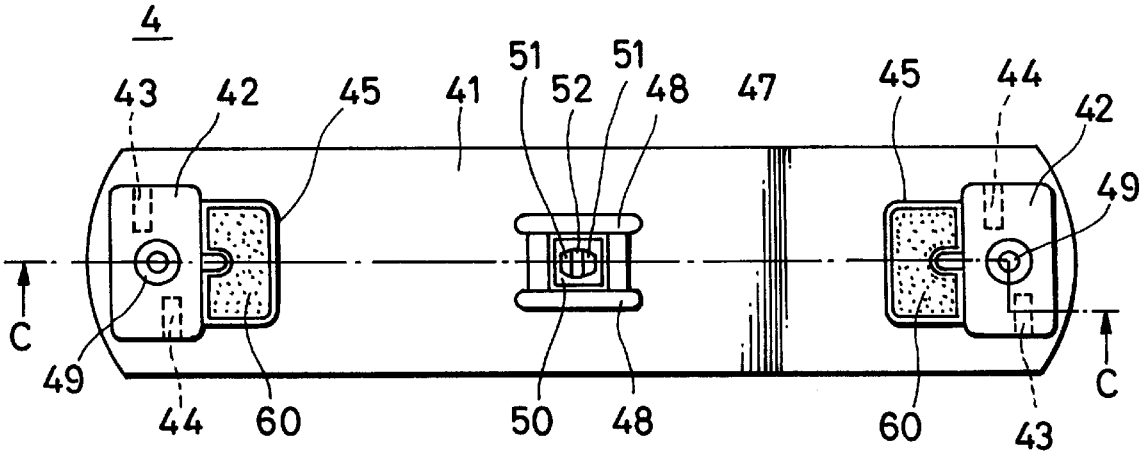
FIGS. 10A to 10D are respectively a plan view of a base of the handle apparatus in the embodiment, a side view of the base, a cross-sectional view of the base taken along line C—C in FIG. 10A, and a bottom view of the base.
Figure 10B:
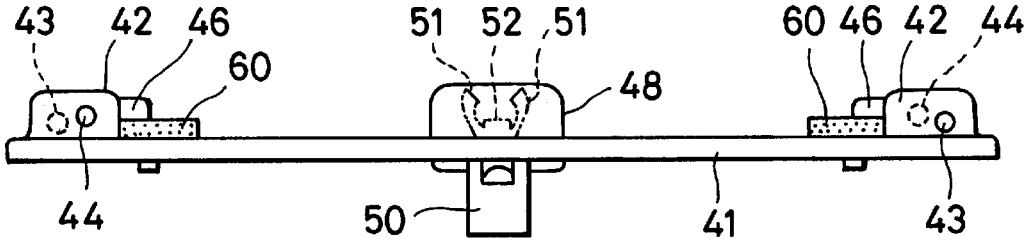
Figure 10C:
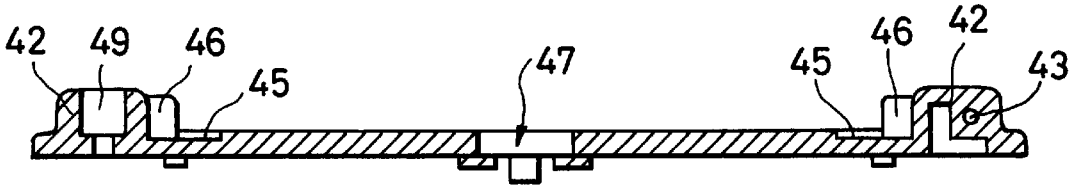
Figure 10D:
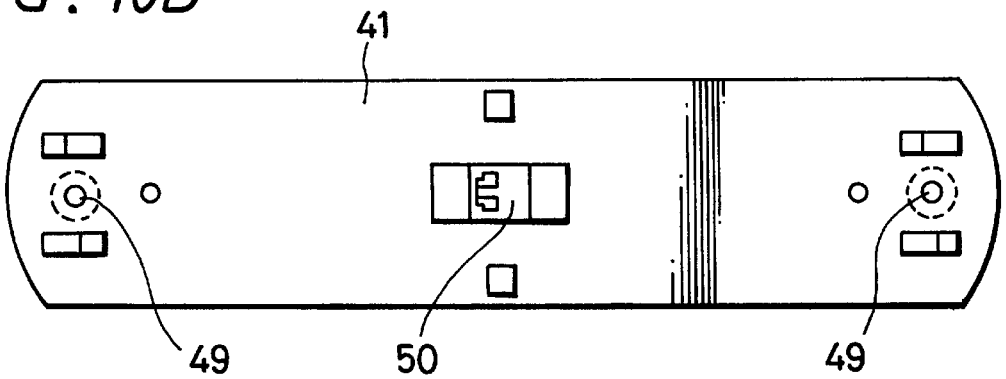

FIGS. 10A to 10D are respectively a plan view of the base 4, a side view of the base 4, a cross-sectional view of the base 4 taken along line C—C in FIG. 10A, and a bottom view of the base 4. FIGS. 10A, 10B and 10D show states in which the lock member 50 and a spacer 60 are attached to a body portion 41 as the base 4. FIG. 10C shows only the body portion 41 integrally molded by resin.

The links 3, 3 are rotatably attached to the base 4. To this end, shaft bases 42, 42 are formed at left-hand and right-hand end portions of the body portion 41 of the base 4 on its upper face.

Shaft holes 43, 44 are formed through the shaft bases 42, 42 on its left-hand and right-hand, sides, respectively. Axial lines of these shaft holes 43 and 44 are shifted from each other as can be clearly seen from FIGS. 10A and 10B. The shaft hole 43 located on an outer side on the body portion 41 in each of the left-hand and right-hand directions in these figures is set to a shaft hole corresponding to the shaft portion 31 of the link 3, and the shaft hole 44 is set to a shaft hole corresponding to the shaft portion 32 of the link 3.

As can be seen from FIGS. 10A, 10C and 10D, a screw hole 49 is formed in a central portion of each of the shaft bases 42, 42. As shown in FIG. 3, the base 4 is fixed onto the cabinet on the upper face side of the apparatus by a screw inserted into each of the two screw holes 49, 49.

A rib 46 is continuously connected to each of the shaft bases 42, 42. As can be seen from FIG. 10C, a spacer arranging portion 45 is formed on a lower side of this rib 46 in a state in which the spacer arranging portion 45 is recessed by one step.

For example, the spacer 60 as a cushion member made of boron, etc. is fixed onto this spacer arranging portion 45 by an adhesive, etc. The spacer 60 has an elastic property similar to rubber and a sponge.

An attaching hole 47 is formed in a portion between ribs 48 and 48 at a central portion of the body portion 41. The lock member 50 is fixedly mounted to this attaching hole 47.

For example, this lock member 50 is constructed as a so-called push latch and when a central push contact portion 52 is pushed-in, this push contact portion 52 and engaging portions 51, 51 on both sides of the push contact portion 52 are recessed down within the lock member. At this time, the distance between tip ends of the engaging portions 51 and 51 is narrowed. Namely, when the lock pin 23 of the handle grip 2 pushes the push contact portion 52 down, the lock pin 23 is engaged with the engaging portions 51, 51 on both the sides of the push contact portion 52.

When the push contact portion 52 is further pressed from the engaging state, the push contact portion 52 and the engaging portions 51, 51 are released from their recessed states and are returned to states projecting upward from the interior of the lock member. At this time, the distance between the tip ends of the engaging portions 51, 51 is widened. Namely, when the push contact portion 52 is pushed down by further pushing an upper face of the handle grip 2 in the engaging state of the lock pin 23 of the handle grip 2, the engaging portions 51, 51 on both the sides of the push contact portion 52 are disengaged from the lock pin 23.

The ribs 48, 48 have functions for protecting the engaging portions 51, 51 of the lock member 50 and limiting a pushing-in lower limiting position of the lock pin 23.

The handle apparatus 1 as shown in FIGS. 4 and 5 is formed of the handle grip 2, the link 3 and the base 4 as mentioned above.

As can be seen from FIGS. 4 and 5, the connecting portions 35 of the links 3, 3 are respectively inserted into the link holes 22, 22 of the handle grip 2. The shaft portion 31 of each of the links 3, 3 is fitted into the shaft hole 43, and the shaft portion 32 thereof is fitted into the shaft hole 44 so that the handle grip 2 and the base 4 are coupled to each other through the links 3, 3.

It is understood that the link holes 22, 22 are elongated holes and the links 3, 3 are rotatably attached to the shaft bases 42, 42 so that the handle apparatus can be changed from the housed state shown in FIG. 4 to the released state shown in FIG. 5.

Figure 6A:
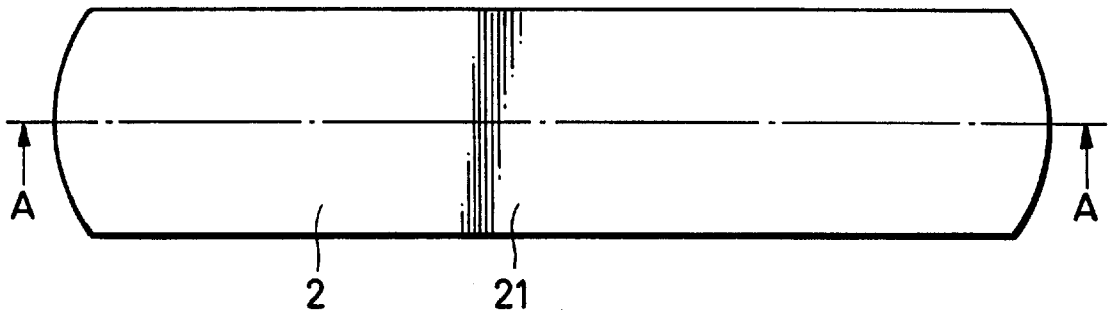
FIGS. 6A to 6C are respectively a plan view of the handle apparatus of the embodiment, a side view of the handle apparatus and a cross-sectional view of the handle apparatus taken along line A—A in FIG. 6A in its housed storing state.
Figure 6B:
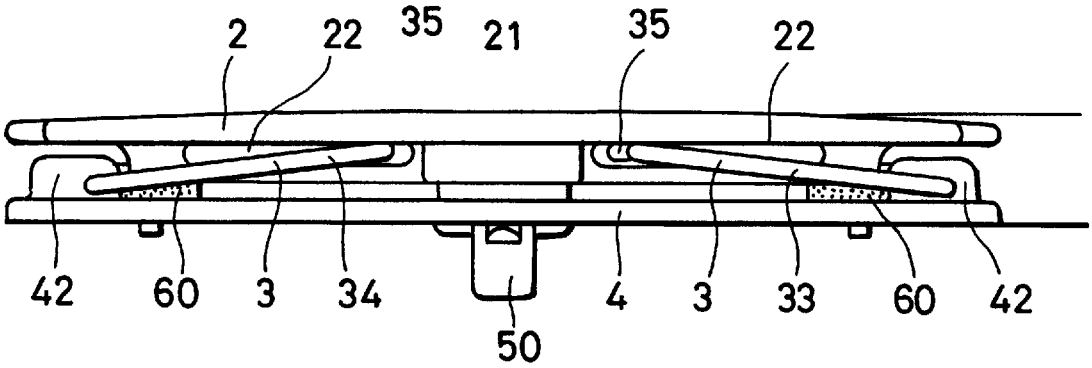
Figure 6C:
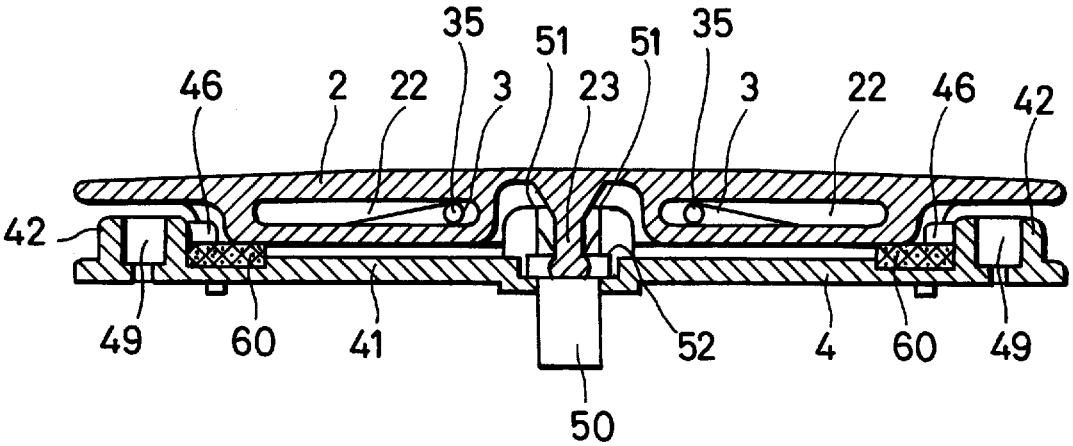

FIGS. 6A to 6C are respectively a plan view of the handle apparatus, a side view of the handle apparatus and a cross-sectional view of the handle apparatus taken along line A—A in FIG. 6A in the storing state of FIG. 4.

Figure 7A:
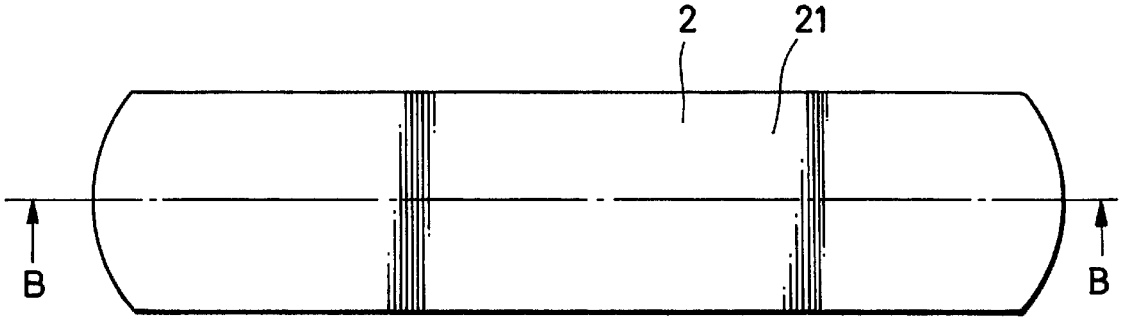
FIGS. 7A to 7C are respectively a plan view of the handle apparatus of the embodiment, a side view of the handle apparatus and a cross-sectional view of the handle apparatus taken along line B—B in FIG. 7A in its released state.
Figure 7B:
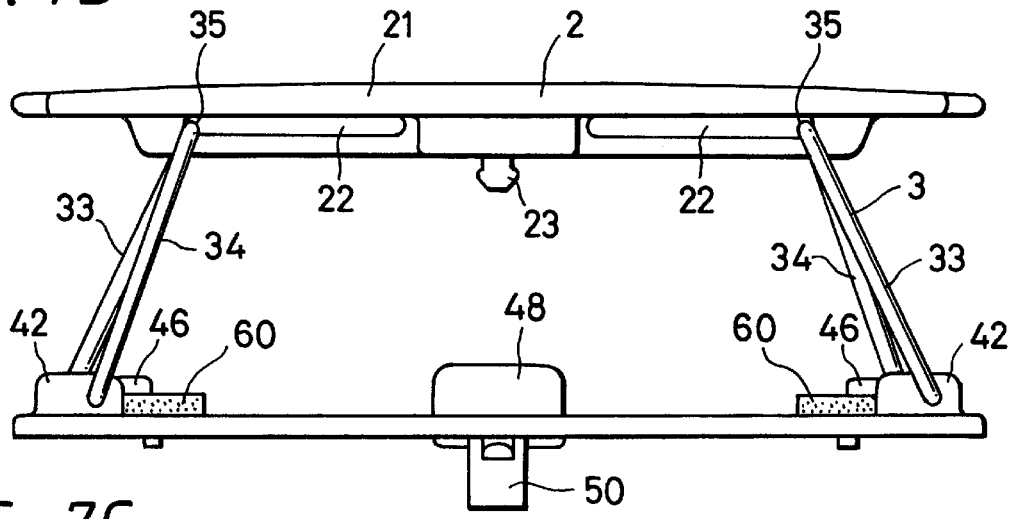
Figure 7C:
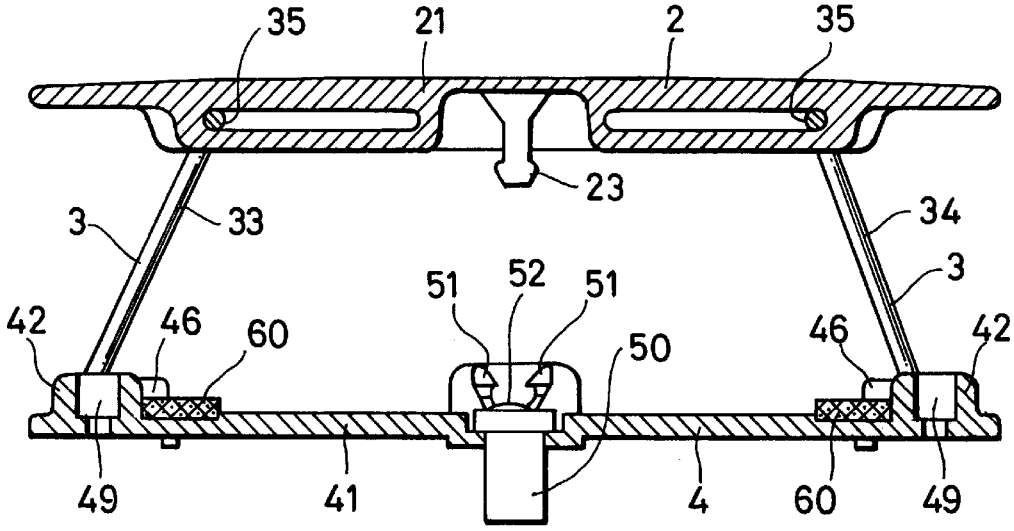

FIGS. 7A to 7C are respectively a plan view of the handle apparatus, a side view of the handle apparatus and a cross-sectional view of the handle apparatus taken along line B—B in FIG. 7A in the released state of FIG. 5.

In the housed state shown in FIG. 4 and FIGS. 6A to 6C, the lock pin 23 of the handle grip 2 is engaged with the lock mechanism 50. At this time, the links 3, 3 are respectively located in falling-down rotating positions seen from the shaft bases 42, 42, and the connecting portions 35 are respectively inserted into inner sides of the elongated holes as the link holes 22, 22 of the handle grip 2.

Further, at this time, a lower face side of the body portion 21 of the handle grip 2 is pressed against the spacer 60. The spacer 60 is deformed by its elasticity such that an upper face of the spacer 60 is slightly recessed by pressing this spacer 60 against the body portion 21 although this construction is not shown in the drawings.

In each link 3 set to the falling down state at this housed time, biasing force for returning each link 3 to its rising state is generated.

This biasing force will be explained with reference to FIGS. 11 to 13.

Figure 11A:
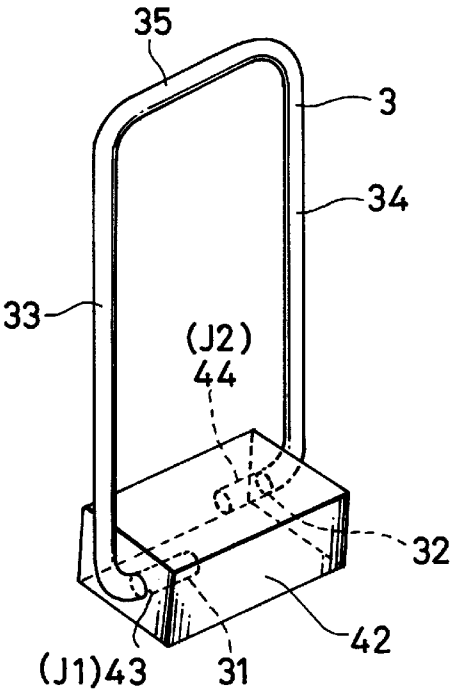
FIGS. 11A and 11B are views for explaining a rotating position of the link of the embodiment.
Figure 11B:
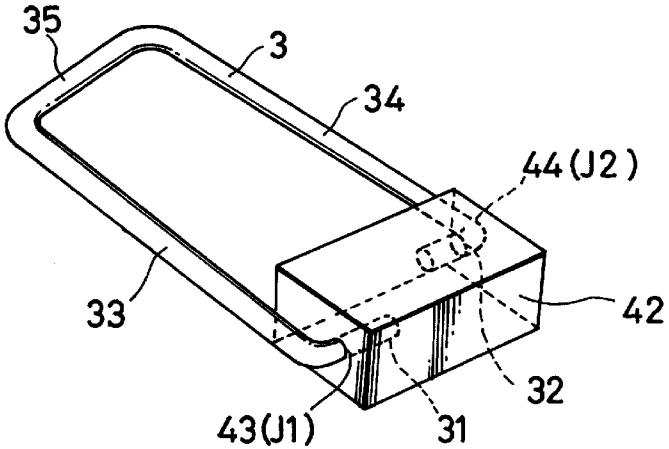

FIGS. 11A and 11B respectively show rising up and falling down states of the link 3 with respect to the shaft base 42. As mentioned above, axial lines of the arms 33 and 34 are shifted from each other.

Figure 12:
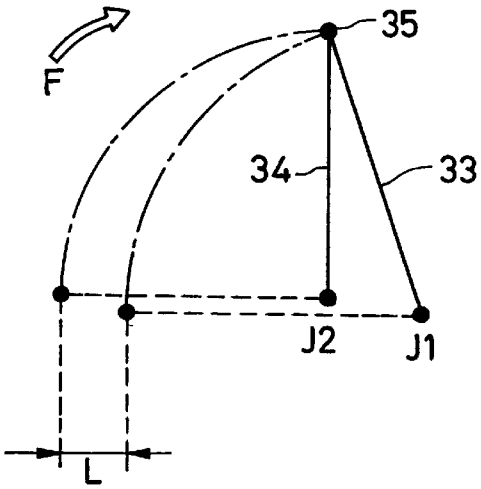
FIG. 12 is a view for explaining the generation of the biasing force of the link of the embodiment.

When axial positions of the arm portions 33 and 34 are set to J1 and J2, respectively, a model at a rising up time of the link 3 is shown by a solid line of FIG. 12. This model shows a state in which the arms 33, 34 connected to each other through the connecting portion 35 are supported at the different axial positions J1, J2 and are stabilized.

Here, when the link 3 is rotated and attains the falling down state as shown in FIG. 11B, the handle apparatus attains the housed state as shown in FIG. 4.

At this time, a rotating locus of each of tip ends (on a side of the connecting portion 35) of the arms 33, 34 is provided as shown by a one-dotted chain line in FIG. 12. In the falling down states of the arms 33, 34 shown by broken lines, a shift shown by reference numeral L in FIG. 12 is caused at the tip ends of these arms (portions connected to each other through the connecting portion 35).

Figure 13A:
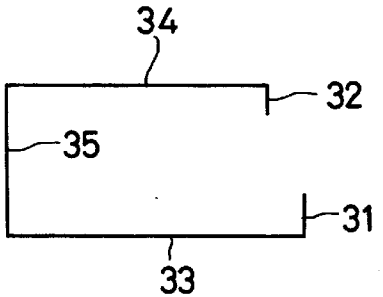
FIGS. 13A and 13B are views for explaining the generation of the biasing force of the link in the embodiment.
Figure 13B:
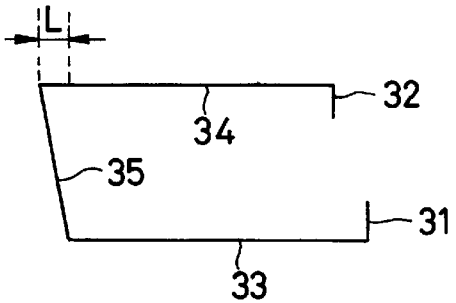

FIGS. 13A and 13B show deforming states of the link 3 shown by the solid and broken lines of FIG. 12 as shape models. Namely, in FIG. 13A, the connecting portion 35 is bent as designed in shape with respect to the arms 33, 34 so that the connecting portion 35 is stable. However, when the connecting portion 35 attains a state of the broken line of FIG. 12, deformation is caused by a shift L shown in FIG. 13B between the connecting portion 35 and the arms 33, 34. Namely, the force causing the deformation is applied to the link 3.

This force causing the deformation is generated since the axial positions J1 and J2 are different from each other and the loci of the arms 33, 34 are different from each other as shown in FIG. 12.

Force for returning the link 3 from a deforming state to a stable state is generated in the link 3 itself. Namely, this force becomes a biasing force for rotating the link 3 in a rising direction as shown by "F" in FIG. 12.

As can be seen from the above explanation, the biasing force for rotating each of the links 3, 3 in the rising direction is generated in each of the links 3, 3 in the housed state shown in FIGS. 4 and 6. However, the lock mechanism 50 is engaged with the lock pin 23 so that the handle grip 2 is held in the housed position against the biasing force of each of the links 3, 3.

When an upper face of the handle grip 2 is pressed from the housed state shown in FIGS. 4 and 6, the lock pin 23 is disengaged from the lock mechanism 50.

Then, since the factor preventing the biasing force of each of the links 3, 3 is removed, each of the links 3, 3 is rotated in the rising direction. At this time, the connecting portions 35, 35 of the links 3, 3 are respectively moved toward the outer side of the link holes 22, 22 while the connecting portions 35, 35 are slid within the link holes 22, 22. As shown in FIG. 7B, the rotations of the links 3, 3 are stopped when the connecting portions 35, 35 respectively reach outermost positions of the link holes 22, 22.

Namely, as shown in FIGS. 5 and 7, the handle grip 2 is popped up so that a user can grip the handle grip 2. Each of the arms 33, 34 of the links 3, 3 functions as a grip arm of the handle apparatus.

Sizes or positions of the elongated holes of the link holes 22, 22 may be set such that the links 3, 3 are not respectively rotated until positions providing perfect stable states when the handle grip 2 is popped up. In this case, as shown in FIG. 7, the biasing force for further moving each link 3 in the rising direction is also left in a state in which the rotation of the link 3 in the rising direction is stopped by the link hole 22. Accordingly, this biasing force becomes a force for pulling each of inner walls of the link holes 22, 22 by the connecting portions 35, 35 of the two links 3, 3 in an outside direction. The handle grip 2 is pulled to the both sides thereof by such pulling force of each of the links 3, 3. Accordingly, the handle grip 2 connected to the links 3, 3 by only inserting the links 3, 3 into the respective link holes 22 is not unstable in such a releasing state (a popped-up state) so that the handle grip 2 preferably functions as a grip at a carrying time of the apparatus.

Thus, the pop-up operation is realized by utilizing the biasing force caused by rotating the link 3 in a different axial position in a falling direction. Accordingly, the handle apparatus 1 of a pop-up type is realized by a very simple construction and a small number of parts in this example. Therefore, advantages of the pop-up type can be obtained. Namely, as shown in FIG. 3, a required handle area on the upper face of an apparatus box body can be reduced and a degree of freedom can be increased in design and appearance design of the apparatus. Further, defects of the pop-up type such as a complicated mechanism, a large-sized structure of the handle apparatus itself, an increase in cost, etc. can be solved.

Further, in this example, the spacer 60 is pressed against the handle grip 2 in the housed state. Accordingly, it is possible to preferably hold a posture of the handle grip 2 in the housed time at which the lock mechanism is engaged with only the lock pin 23 against the biasing of each of the links 3, 3. Namely, it is possible to prevent an external appearance of the handle grip 2 from getting worse since the handle grip 2 housed onto an apparatus upper face of the projector 90 of FIG. 3 is inclined from a horizontal state.

Further, durability of the handle apparatus is improved by forming the spacer by an elastic material such as boron, etc. in comparison with a case in which a portion coming in press contact with the handle grip 2 is integrally formed in the body portion 41 by utilizing e.g., elastic deformation of resin, etc.

Further, in this example, the arms 33 and 34 are set to have different lengths as explained with reference to FIG. 8.

The lengths of the arms 33 and 34 are set in accordance with different axial positions of the respective arms and different distances from the arms to the link holes 22. Namely, the distance from the shaft hole 43 to an end portion of the link hole 22 is longer than the distance from the shaft hole 44 to an end portion of the link hole 22. Therefore, the length W1 of the arm portion 33 is set to be longer by this increase in length than the length W2 of the arm portion 34 so that the connecting portion 35 is approximately held in a horizontal state within the link hole 22 in the popped-up state of FIG. 7.

Namely, since the handle grip 2 is held approximately horizontal, the handle grip 2 can preferably function as a grip and an external appearance of the handle grip 2 can be set to be preferable.

The above embodiment is explained as an example. However, there is no need to say that various kinds of other shapes, structures, etc. are considered with respect to the spring member, the handle apparatus and the portable apparatus in the present invention.

For example, in contrast to the above example, the spring member may be formed by bending a shaft portion approximately 90° from a U-shaped portion in an external direction (a direction reverse to an arranging direction of the other arm). It is also considered as an example that one shaft portion is bent in an inner direction (the arranging direction of the other arm) and the other shaft portion is bent in an outer direction.

As the handle apparatus, various kinds of shapes of parts such as the handle grip 2, the link 3 and the base 4 may be changed. Further, the lock mechanism is not limited to a push latch type, but the lock releasing system is set to be different in accordance with an adopted mechanism.

Various kinds of devices such as a compact television receiver, a printer, a personal computer of a portable type, etc. are considered in addition to the projector as shown in FIG. 3 as the portable apparatus of the present invention.

As explained above, the spring member of the present invention is formed in a state in which a wire rod is bent in an approximately U-shape. Both tip end portions of the spring member formed in the approximately U-shape are bent at an approximately right angle as shaft portions for rotating the approximately U-shaped portions. Both the shaft portions thereof are set to states in which no axial lines of the shaft portions are in conformity with each other. Accordingly, it is possible to realize a member for generating the biasing force in accordance with a rotating position as a very simple part.

The handle apparatus of the present invention uses the above spring member as a member for generating the biasing force for the popping-up operation. The base member and the handle grip member are connected to each other through a pair of spring members. The handle grip member is held on a side of the base member against the biasing of the spring members by the lock mechanism arranged on the base member side. Thus, the handle grip member is popped up by releasing the lock member. Namely, it is possible to realize the handle apparatus of a pop-up type by a very simple construction and a small number of parts.

Further, the above handle apparatus is adopted as a portable apparatus of the present invention so that an external appearance of the portable apparatus is preferably improved and a carrying function of the pop-up handle is preferably provided. Further, a degree of freedom in design of the portable apparatus can be increased and cost of the portable apparatus, etc. can be also reduced.

Having described preferred embodiments of the invention with reference to the accompanying drawings, it is to be understood that the invention is not limited to those precise embodiments and that various changes and modifications could be effected therein by one skilled in the art without departing from the spirit or scope of the invention as defined in the appended claims.

What is claimed is:

1. A handle apparatus comprising:

a base member;

a handle grip member;

a pair of spring members each pivotably attached to said base member and each pivotably attached to said handle grip member for movably connecting said handle grip member to said base member; and a lock mechanism formed on a side of said base member for holding said handle grip member in a retracted state on said base member side, wherein each of said spring members is formed of a wire rod bent to form first and second arms connected by a connecting portion and the first and second arms having respective tip end portions at free ends thereof, wherein said respective tip end portions function as shaft portions for rotating said first and second arms and said connecting portion formed of said wire rod and wherein said shaft portions are pivotably supported on said base member in a state in which respective axes of said shaft portions are not aligned with each other, so as to generate a biasing force in each of said spring members for biasing said handle grip member in a direction releasing said handle grip member away from said base member, and said handle grip member is raised to a position separated from said base member by said biasing force of each of said spring members such that holding of said handle grip member by said lock mechanism is released.

2. The handle apparatus as claimed in claim 1, wherein each of said spring members is formed of a wire rod bent in an approximately U-shaped and respective tip end portions of each of said spring members are bent approximately at right angles to a respective one of a pair of arm portions and serve as said shaft portions for rotating said approximately U-shaped wire rod.

3. The handle apparatus as claimed in claim 2, wherein said spring members are in a stable state when said handle grip member is raised to said position separated from said base member.

4. The handle apparatus as claimed in claim 2, wherein said spring members are in a deformed state when in said retracted state.

5. A portable apparatus carried by using a handle apparatus, said portable apparatus comprising:

a handle grip member;

a pair of spring members each pivotably attached to a handle mounting portion and each pivotably attached to said handle member for movably connecting said handle grip member to said handle mounting portion of said portable apparatus; and a lock mechanism for holding said handle grip member on a side of said handle mounting portion, wherein each of said spring members is formed of a wire rod bent to form first and second arms connected by a connecting portion and the first and second arms having respective tip end portions at free ends thereof, wherein said respective tip end portions of each of said spring members are bent approximately at a right angle to said arms and function as shaft portions for rotating said first and second arms and said connecting portion formed of said wire rod, said shaft portions being pivotably supported on said handle mounting portion such that respective axes of said shaft portions are not aligned with each other, so as to generate a biasing force for biasing said handle grip member connected to each of said spring members in a direction releasing said handle grip member from said handle mounting portion, and said handle grip member is raised to a position separated from said handle mounting portion by said biasing force of each of said spring members such that holding of said handle grip member by said lock mechanism is released.

* * * * *